US008444348B2

(12) United States Patent
Nottingham et al.

(10) Patent No.: US 8,444,348 B2
(45) Date of Patent: May 21, 2013

(54) MODULAR OFFSHORE PLATFORMS AND ASSOCIATED METHODS OF USE AND MANUFACTURE

(75) Inventors: William Dennis Nottingham, Carter, MT (US); Kenton Braun, Anchorage, AK (US)

(73) Assignee: PND Engineers, Inc., Anchorage, AK (US)

( * ) Notice: Subject to any disclaimer, the term of this patent is extended or adjusted under 35 U.S.C. 154(b) by 0 days.

(21) Appl. No.: 12/828,046

(22) Filed: Jun. 30, 2010

(65) Prior Publication Data

US 2011/0002741 A1 Jan. 6, 2011

Related U.S. Application Data

(60) Provisional application No. 61/222,060, filed on Jun. 30, 2009.

(51) Int. Cl.
*E02B 17/00* (2006.01)

(52) U.S. Cl.
USPC ..... 405/227; 405/228; 405/224; 405/204

(58) Field of Classification Search
USPC ..... 405/195.1, 203, 204, 224, 227, 228, 405/217
See application file for complete search history.

(56) References Cited

U.S. PATENT DOCUMENTS

| | | | | | |
|---|---|---|---|---|---|
| 2,909,901 | A * | 10/1959 | Suderow | 405/227 |
| 3,751,930 | A * | 8/1973 | Mott et al. | 405/227 |
| 3,754,403 | A * | 8/1973 | Mott et al. | 405/227 |
| 3,797,258 | A * | 3/1974 | Dubuisson et al. | 405/227 |
| 3,999,396 | A * | 12/1976 | Evans | 405/203 |
| 4,479,742 | A * | 10/1984 | Bruce | 405/217 |
| 4,486,125 | A * | 12/1984 | Reusswig | 405/203 |
| 4,511,288 | A * | 4/1985 | Wetmore | 405/203 |
| 4,579,481 | A * | 4/1986 | Gerwick et al. | 405/227 |
| 4,596,495 | A * | 6/1986 | Scharnell et al. | 405/227 |
| 4,618,286 | A * | 10/1986 | Michel et al. | 405/227 |
| 4,647,257 | A * | 3/1987 | Robishaw | 405/204 |
| 4,890,959 | A * | 1/1990 | Robishaw et al. | 405/204 |
| 5,213,447 | A * | 5/1993 | Srock | 405/227 |
| 5,292,207 | A * | 3/1994 | Scott | 405/217 |
| 6,443,659 | B1 * | 9/2002 | Patout | 405/203 |
| 6,499,914 | B1 * | 12/2002 | Patout et al. | 405/203 |
| 7,958,835 | B2 * | 6/2011 | Srinivasan | 405/217 |
| 2007/0163186 | A1 * | 7/2007 | Baugh et al. | 405/195.1 |
| 2008/0286053 | A1 * | 11/2008 | Baugh et al. | 405/204 |
| 2010/0143044 | A1 * | 6/2010 | Kadaster et al. | 405/201 |

* cited by examiner

*Primary Examiner* — Frederick L Lagman
(74) *Attorney, Agent, or Firm* — Perkins Coie LLP

(57) ABSTRACT

Modular offshore platform systems and associated methods of transport and assembly are disclosed herein. A method of transporting a modular offshore platform to an offshore location in accordance with an embodiment of the disclosure includes transporting towing a first platform portion of the offshore platform to an offshore location and transporting a second platform portion of the offshore platform to the offshore location separately from the first platform portion. The method further includes attaching the second platform portion to the first platform portion at the offshore location, and anchoring at least one of the first and second platform portions to a sea floor at the offshore location.

20 Claims, 11 Drawing Sheets

MODULAR OFFSHORE PLATFORMS AND ASSOCIATED METHODS OF USE AND MANUFACTURE

CROSS-REFERENCE TO RELATED APPLICATION(S)

The present application claims priority to U.S. Provisional Application No. 61/222,060, filed Jun. 30, 2009, and incorporated herein in its entirety by reference

TECHNICAL FIELD

The following disclosure relates generally to offshore platforms, and more specifically to systems, structures, and methods associated with arctic offshore modular platforms for drilling, exploration, and the like.

BACKGROUND

Offshore platforms, such as oil platforms, are typically used for exploratory drilling, oil drilling, and other related processes at sea. The use of such offshore platforms in arctic waters, however, is complicated by large quantities of moving ice in these waters that can damage or otherwise disrupt such platforms. The use of offshore arctic platforms is further complicated by the frequently stormy or rough seas in arctic waters. With reference to exploratory drilling in arctic waters, exploratory drilling offshore platforms are typically unitary platforms or structures that occupy a relatively small space with reference to the drilling equipment. For production drilling in offshore arctic locations, fully submerged gravel islands have been used. Such gravel islands can include a gravel ballast so that the gravel island rests on or is otherwise connected to the seafloor. Accordingly, such gravel islands are fully submerged non-floating structures.

DETAILED DESCRIPTION

Several embodiments of the disclosure are described below with reference to a modular platform system that is configured for use in arctic waters including icy conditions. Specific details are identified in the following description with reference to FIGS. 1-5H to provide a thorough understanding of various embodiments of the disclosure. Other details describing well-known structures or processes often associated with offshore platforms, however, are not described below to avoid unnecessarily obscuring the description of the various embodiments of the disclosure. Moreover, although the following disclosure sets forth several embodiments of different aspects of the invention, other embodiments can have different configurations and/or different components and structures than those described in this section. In addition, further embodiments of the disclosure may be practiced without several of the details described below, while still other embodiments of the disclosure may be practiced with additional details and/or features.

Figure 1:
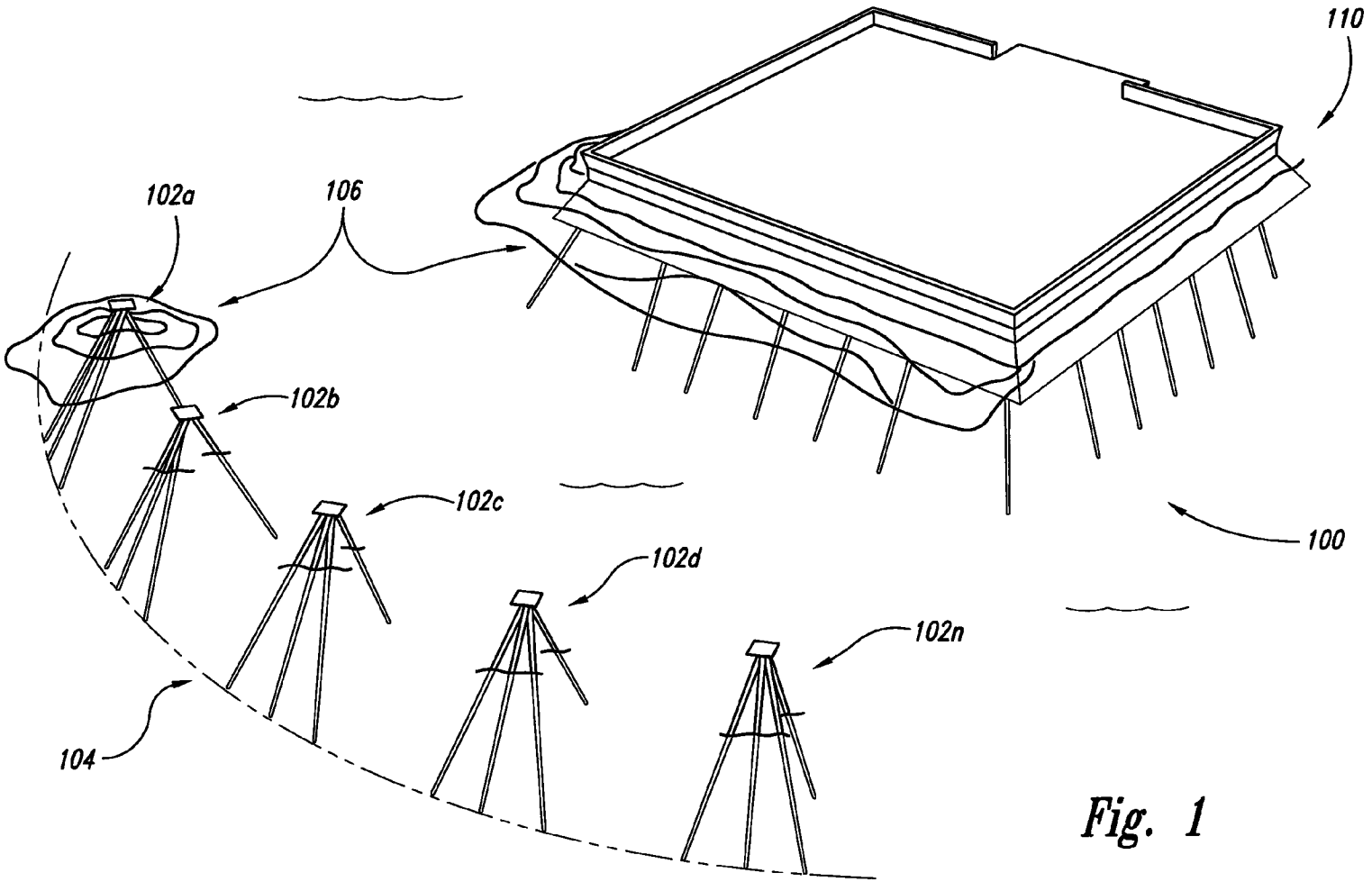
FIG. 1 is an isometric view of a platform system configured in accordance with an embodiment of the disclosure.

The present disclosure is directed generally to modular offshore platforms and associated methods for assembling, manufacturing, and operating such platforms. FIG. 1, for example, is an isometric view of a platform system 100 configured in accordance with an embodiment of the disclosure. The system 100 is configured for drilling, exploring, and/or similar uses in medium-depth arctic waters (e.g., approximately 50-150 feet) with substantial amounts of ice. Although the system 100 described herein is suited for medium-depth arctic waters, in other embodiments the system 100 and/or components thereof can be used in other conditions including, for example, shallow water (e.g., less than approximately 50 feet). As shown in FIG. 1, the system 100 includes a modular barge or platform 110. The platform 110 may or may not be spaced apart from a plurality of rubble generators 102 (identified individually in FIG. 1 as first through $n^{th}$ rubble generators 102*a*, 102*b* . . . 102*n*). The rubble generators 102 may be required as supplemental protection to the platform 110 or the platform may be provided solely without supplemental protection. Rubble generators 102 will likely only be required in areas exposed to thick, competent ice floes (e.g., multi-year ice, icebergs, etc.) and will break up or stop ice encroaching from the direction indicated by arrow 104 to create ice rubble 106. In this manner, the ice rubble 106 accumulates and/or flows around the platform 110 such that large quantities of thick, competent ice do not impact or otherwise damage the platform 110. In other embodiments where thick competent ice is not likely, the rubble generators 102 may be omitted. The ice is then resisted solely by the platform 110. As explained in detail below with reference to FIGS. 1-5H, the platform 110 is a modularized structure that provides several advantages for transportation, construction, and use in arctic medium-depth waters.

Figure 2:
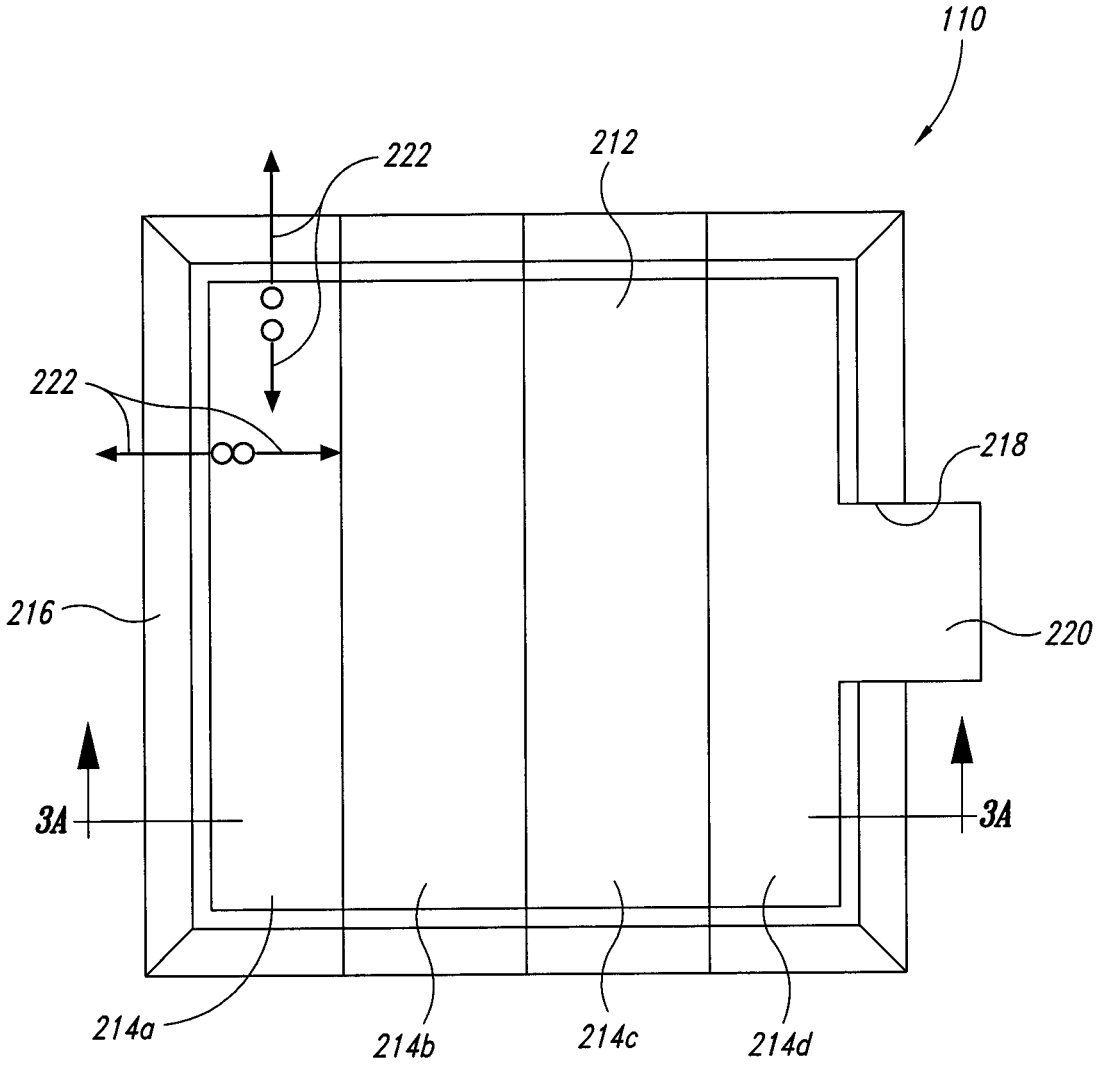
FIG. 2 is a top view of a platform configured in accordance with an embodiment of the disclosure.

FIG. 2 is a top view of the platform 110 configured in accordance with an embodiment of the disclosure. As shown in FIG. 2, the platform 110 includes a modular platform body 212 that is made up of multiple platform portions 214. For example, in the illustrated embodiment, the platform body 212 includes first through fourth platform portions 214*a*-214*d* that are connected to one another to form the platform 110. As described in detail below, the individual platform portions 214 can have a generally rectangular shape and be positioned adjacent to one another such that the platform body 212 has a generally square or rectangular shape. In one embodiment, for example, the platform 110 can be approximately 400 feet by 400 feet square (e.g., approximately 160, 000 square feet). In other embodiments, however, the platform 110 can be a different size and the platform body 212 can include more than or less than four platform portions 214. Moreover, the platform body 212 and/or the platform portions 214 can include other shapes including for example, rectilinear, curved, oblong, and/or irregular shapes.

When the platform portions 214 are assembled together (i.e., when interior surfaces of the corresponding platform portions 214 are attached to one another) they form an outer wall 216 extending substantially around a periphery of the platform body 212. In certain embodiments, the wall 216 includes an opening 218 at a dock 220 to provide access to the platform 110. Although only one dock 220 is shown in FIG. 2, in other embodiments the platform 110 can include multiple docks 220 at various locations around the platform body 212. Moreover, in still further embodiments, the wall 216 can be configured to open and close at the dock 220 to keep water and/or ice from entering the platform 110.

According to another feature of the illustrated embodiment, and as described in detail below, the platform 110 includes multiple sets of anchor piles 222 coupled to the platform body 212 to anchor the platform 110 to the seafloor and stabilize the platform 110 at a desired location. Although only two sets of anchor piles 222 are shown in FIG. 2, the platform 110 can include multiple anchor piles 222 attached at various locations to the platform body 212. In certain embodiments, the anchor piles 222 can be SPIN FIN® anchor piles, available from PND Engineers, Inc., 1506 West 36$^{th}$ Avenue, Anchorage Ak., 99503. SPIN FIN® anchor piles can also be used with the rubble generators 102 described above with reference to FIG. 1. In certain embodiments, and as shown in FIG. 2, the anchor piles 222 can be arranged such that one set of anchor piles 222 can be positioned generally perpendicular to an adjacent set of anchor piles 222.

Figure 3A:
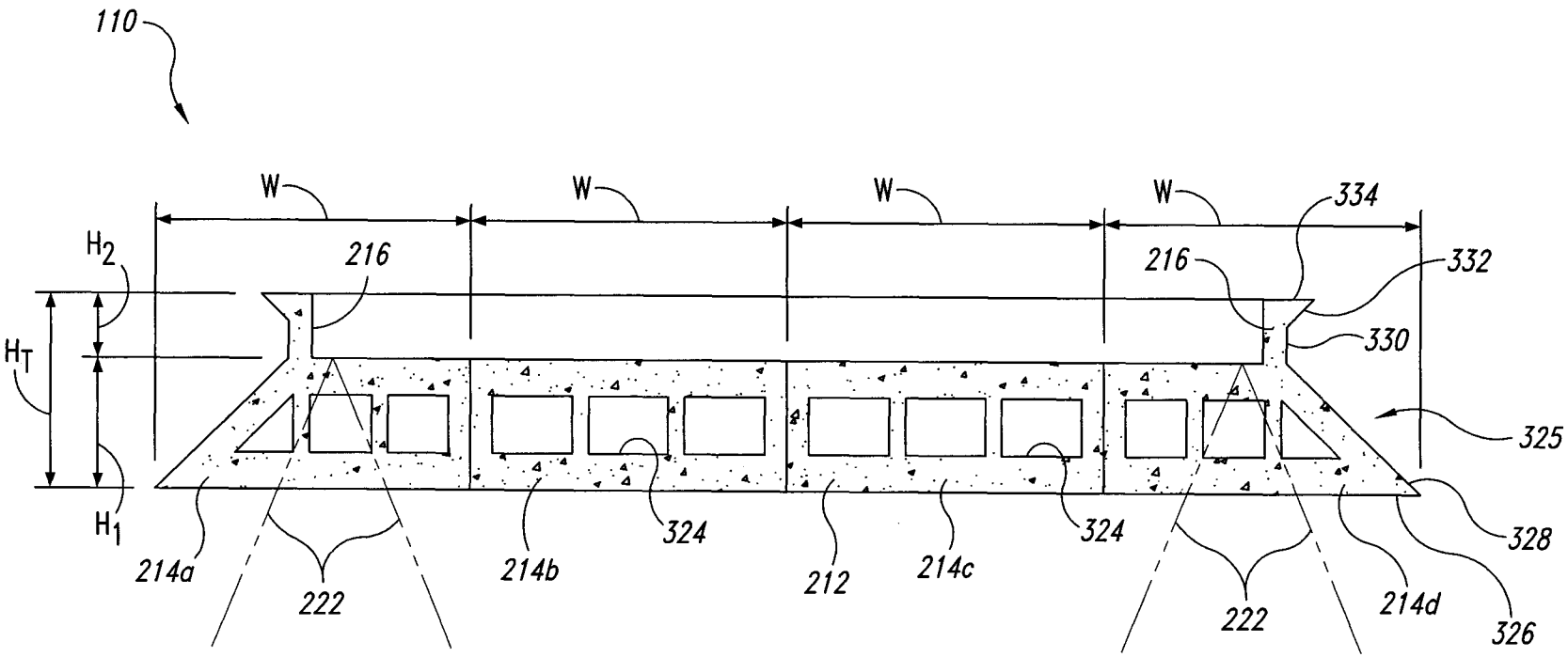
FIG. 3A is a cross-sectional side view taken substantially along the line 3A-3A of FIG. 2.

FIG. 3A is a cross-sectional side view taken substantially along the line 3A-3A of FIG. 2 illustrating several features of the platform body 212. According to one feature of the illustrated embodiment, each platform portion 214 includes multiple cavities or openings 324. The openings 324 can be configured to control the weight of the platform portions 214. In addition, in certain embodiments the openings 324 can also be used to control the buoyancy and stability of the platform 110. For example, the openings 324 can be ballast cavities and/or house ballast tanks that can be filled or emptied to adjust the buoyancy of the platform. Moreover, in still further embodiments, the openings 324 can be used as storage cavities for stowing materials and equipment during transport and/or during operation of the platform 110. Each of the platform portions 214 can be made from concrete, steel, a combination of these materials, and/or other materials suitable for offshore platforms.

According to yet another feature of the illustrated embodiment, each of the platform portions 214 has an individual width W. In certain embodiments, the individual width W can be approximately 100 feet, giving the platform 110 a total width of 400 feet. In addition, the length of each platform portion (e.g., in the directions into and out of the plane of FIG. 3A) can be approximately 400 feet. As such, and as described above, the assembled platform portions 214 can form a generally square shape that is approximately 400 feet wide by 400 feet long. In other embodiments, however, the individual width W of each platform portion 214 can be greater than or less than 100 feet, and the individual length of each platform portion 214 can be greater than or less than 400 feet, and the final assemblage can vary in width and length by greater than or less than 400 feet.

As also shown in the embodiment illustrated in FIG. 3A, the platform can have a total height $H_T$ from a bottom surface 326 to a top surface 334 of the platform body 212. In certain embodiments, the total height $H_T$ can be approximately 62 feet. In other embodiments, however, the total height $H_T$ can be greater than or less than 62 feet, depending upon wave and ice conditions. In addition, the platform 110 includes an exterior side wall 325 extending from the bottom surface 326 to the top surface 334. The exterior side wall 325 is exposed to the water and therefore configured to protect the platform 110 from the water and/or ice. The exterior side wall 325 includes a first inclined face 328 extending from the bottom surface 326, a vertical face 330 extending from the first inclined face 328, and a second inclined face 332 extending from the vertical face 330 to the top surface 334. In certain embodiments, the first inclined face 328 can have a first height $H_1$ from the bottom surface 326 that is approximately 37 feet. Moreover, the combination of the vertical face 330 and the second inclined face 332 can have a second height $H_2$ that is approximately 25 feet. Furthermore, the first inclined face 328 and the second inclined face 332 can each be positioned at approximately a 45 degree angle relative to the vertical face 330. As explained in detail below, the platform body 212 is configured such that at least a portion of the first inclined face 328 can be submerged in the water. The first inclined face 328 can act to force advancing ice sheets to ride up the inclined face and fail in bending, thus reducing the ice load imparted to the structure. Alternatively, the first inclined face could also be constructed vertically in certain embodiments. Moreover, the second inclined face 332 acts as a wave and ice rubble deflector that at least partially prevents waves and/or ice from flowing over the side wall 216 into the platform 110.

Figure 3B:
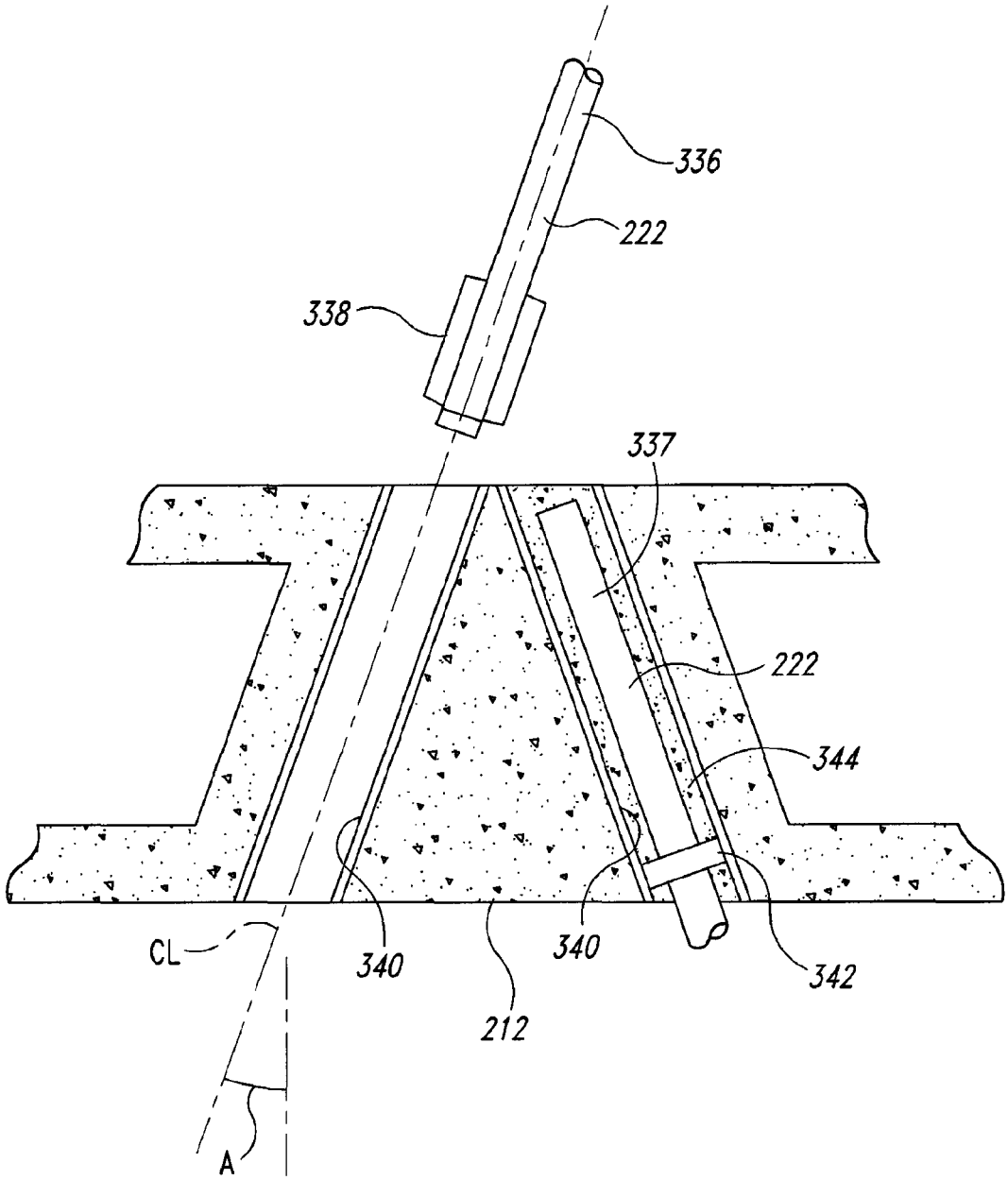
FIG. 3B is an enlarged cross-sectional side view of a portion of the platform of FIG. 3A.

As also schematically shown in FIG. 3A, the anchor piles 222 are attached to the platform 110 and extend through a portion of the platform body 212. More specifically, FIG. 3B is an enlarged cross-sectional side view of a portion of a platform body 212 illustrating the attachment of the anchor piles 222 to the platform body 212. As shown in FIG. 3B, the platform body 212 includes pile openings 340 that receive corresponding anchor piles 222. Each pile opening 340 is sized to allow the corresponding anchor piles 222 to extend through the platform body 212 during assembly. More specifically, in embodiments where SPIN FINS® are used for the anchor piles 222, a plurality of fins 338 extend from the lower end portion 336 of each pile 222. The greatest dimension of the pile opening 340 is larger than the greatest dimension of the lower end portion 336 including the fins 338 such that the anchor piles 222 can be inserted through the pile opening 340 from a top surface of the platform body 212. After the anchor pile 222 is inserted through the pile opening 340, a pile sleeve 342 supports an upper end portion 337 of the anchor pile 222 in the pile opening 340. With the pile sleeve 342 retaining the upper end portion 337 in the pile opening 340 and the lower end portion 336 at least partially embedded in the seafloor (not shown), the upper end portion 337 is fixedly attached to the platform body 212. For example, grout, cement, adhesive, and/or any other suitable type of securing material 344 can be disposed in the pile opening 340 to secure and attach the upper end portion 337 to the platform body 212. In addition to positioning the upper portion 337, the pile sleeve 342 also prevents the securing material 344 from falling out of the pile opening 340.

In certain embodiments, a centerline CL of each anchor pile in 222 is positioned at an angle A that is approximately 20-35 degrees from vertical. In one embodiment, the angle A can be approximately 27 degrees from vertical. In other embodiments, the anchor piles 222 can be positioned at an angle that is greater than 35 degrees or less than 20 degrees from vertical.

Figure 4:
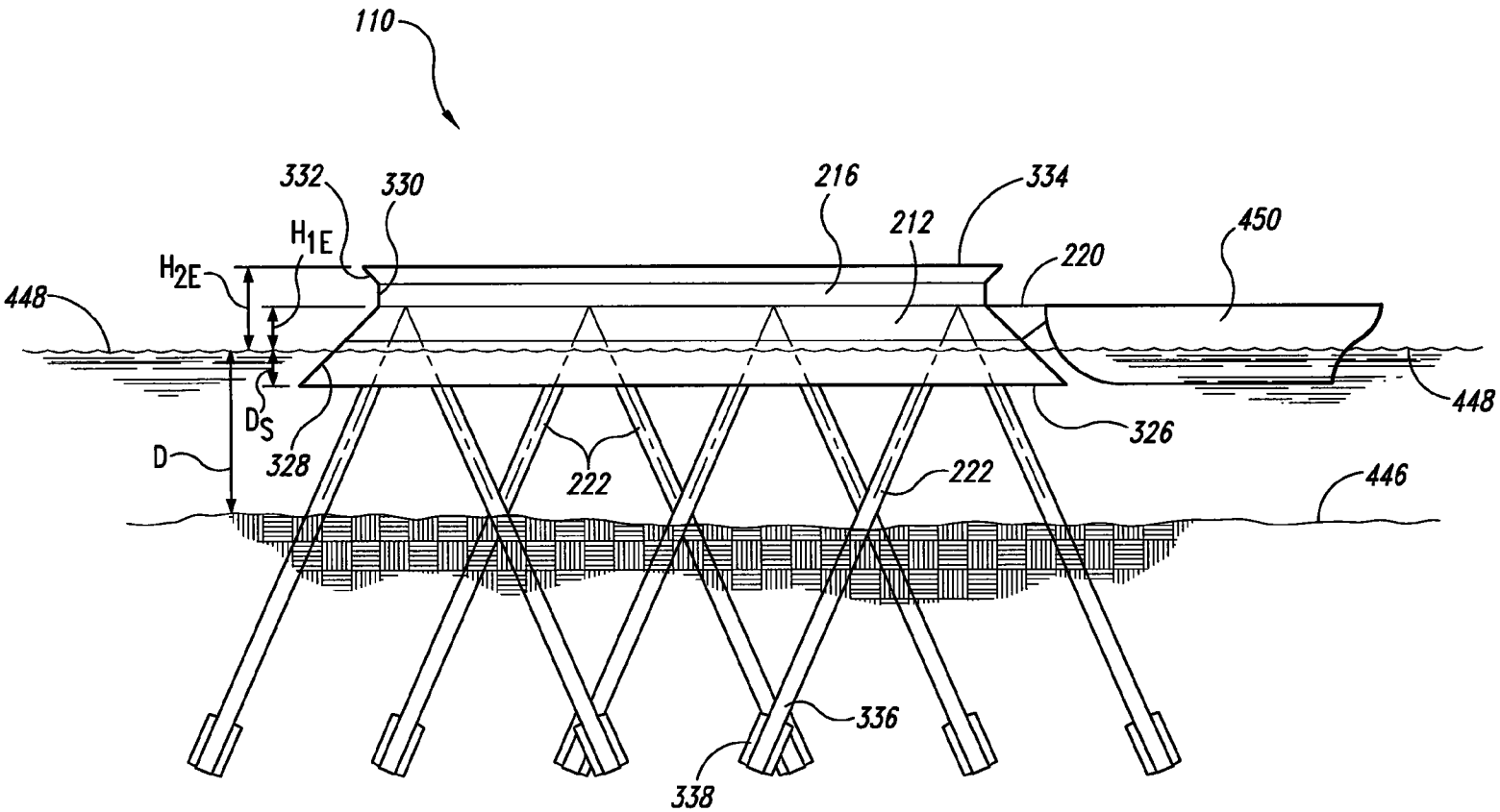
FIG. 4 is a side view of a platform configured in accordance with an embodiment of the disclosure partially submerged in water.

FIG. 4 is a side view of the platform 110 partially submerged in water and secured to a seafloor 446 in accordance with an embodiment of the disclosure. For example, FIG. 4 illustrates the anchor piles 222 extending from the platform body 212. The anchor piles 222 can be attached in sets of two at the platform body 212 as described above with reference to FIG. 3B, and extend into the seafloor 446 such that the fins 338 on the lower end portions 336 of the anchor piles 222 are securely embedded in the seafloor 446.

According to yet another feature illustrated in FIG. 4, a depth D represents the depth from a water surface 448 to the seafloor 446. Although the depth D may vary according to the location where the platform 100 is utilized, in certain embodiments the depth D can be in the range of approximately 50-150 feet. In other embodiments, however, the depth D can be less than 50 feet or greater than 150 feet. FIG. 4 further illustrates the height of several portions of the partially submerged platform body 212 with reference to the water surface 448. As noted above with reference to FIG. 3A, the total height $H_T$ of the platform can be approximately 62 feet. In the illustrated embodiment, with the first inclined face 328 partially submerged in the water, and the platform body 212 is configured such that the bottom surface 326 of the platform body 212 is at a submerged depth $D_S$ that is approximately 25 feet from the water surface 448. Accordingly, the interface of the first inclined face 328 and the vertical face 330 is at a first exposed height $H_{1E}$ that is approximately 12 feet above the water surface 448, and the top surface 334 of the platform body 212 is at a second exposed height $H_{2E}$ that is approximately 37 feet above the water surface 448. The second exposed height $H_{2E}$ at least partially prevents water and/or ice from flowing over the side wall 216 since the top surface 334 of the platform body 212 is sufficiently high above the water surface 448. In addition, the angle of the second inclined face 332 acts as a wave deflector to at least partially deflect water and/or ice from flowing over the sidewall 216. In other embodiments, the dimensions of the various heights can be greater than or less than the values described above.

According to yet another feature illustrated in FIG. 4, a secondary barge 450 is positioned adjacent to the platform 110 at the dock 220. As will be appreciated by one of ordinary skill in the art, the barge 450 can include any type of vehicle, container, or similar structure that can be positioned adjacent to the platform 110. For example, a boat or barge bringing materials or supplies to the platform 110, as well as a separate platform, can be positioned adjacent to the platform body 212 at the dock 220 to facilitate loading from and/or unloading to the platform 110.

Figure 5A:
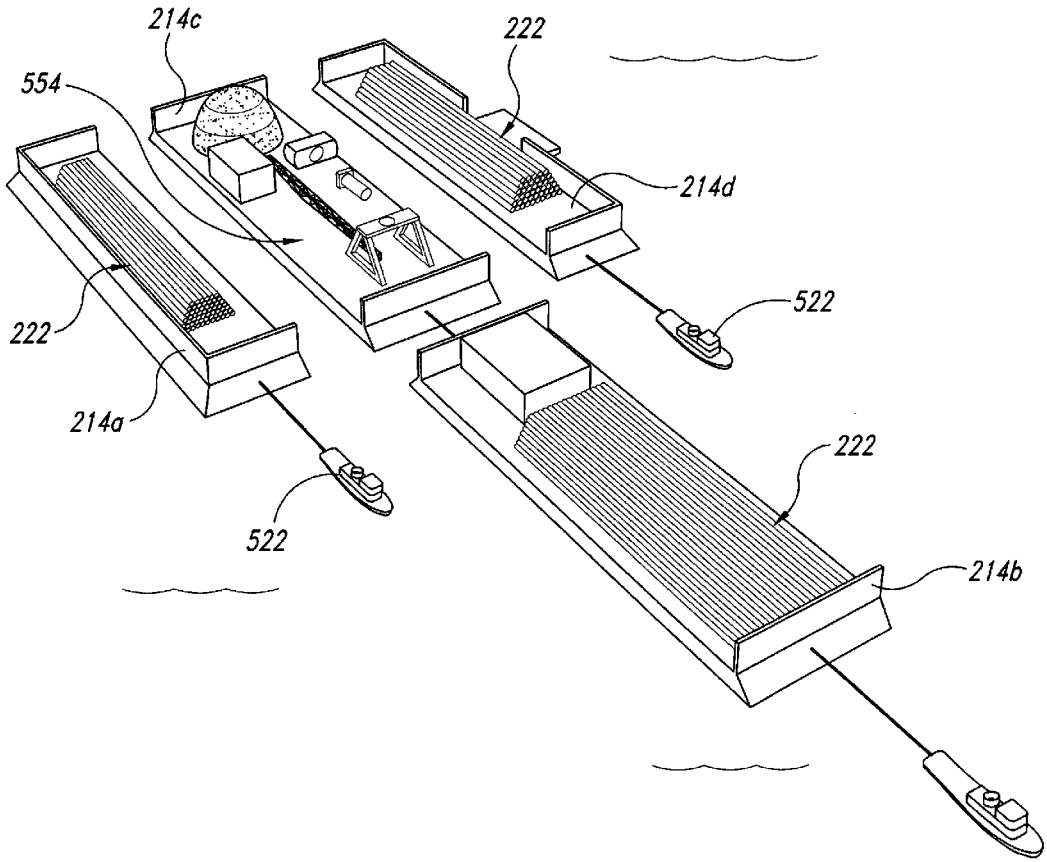
FIGS. 5A-5H are a series of isometric views illustrating various features of a platform system configured in accordance with an embodiment of the disclosure.
Figure 5B:
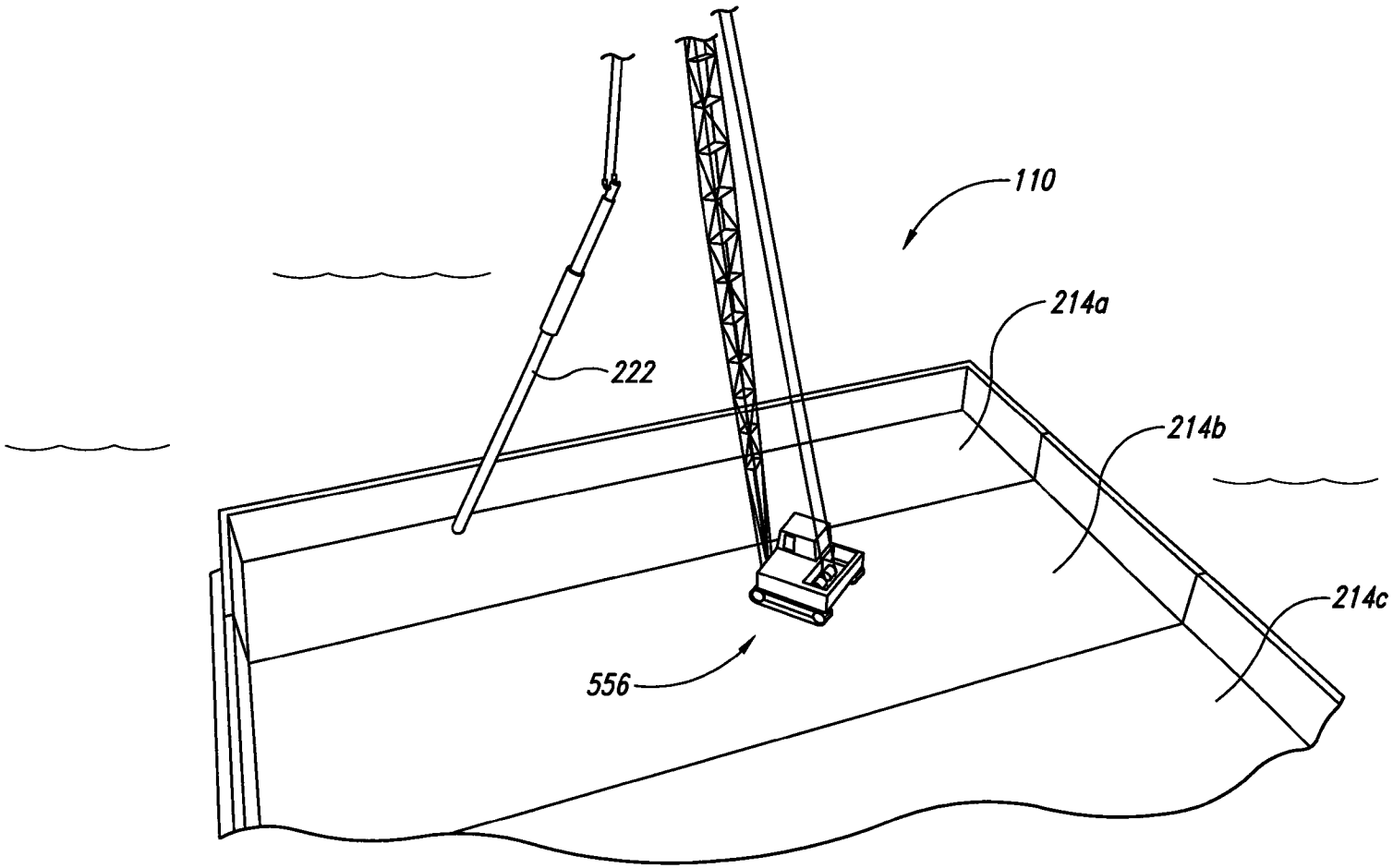
Figure 5C:
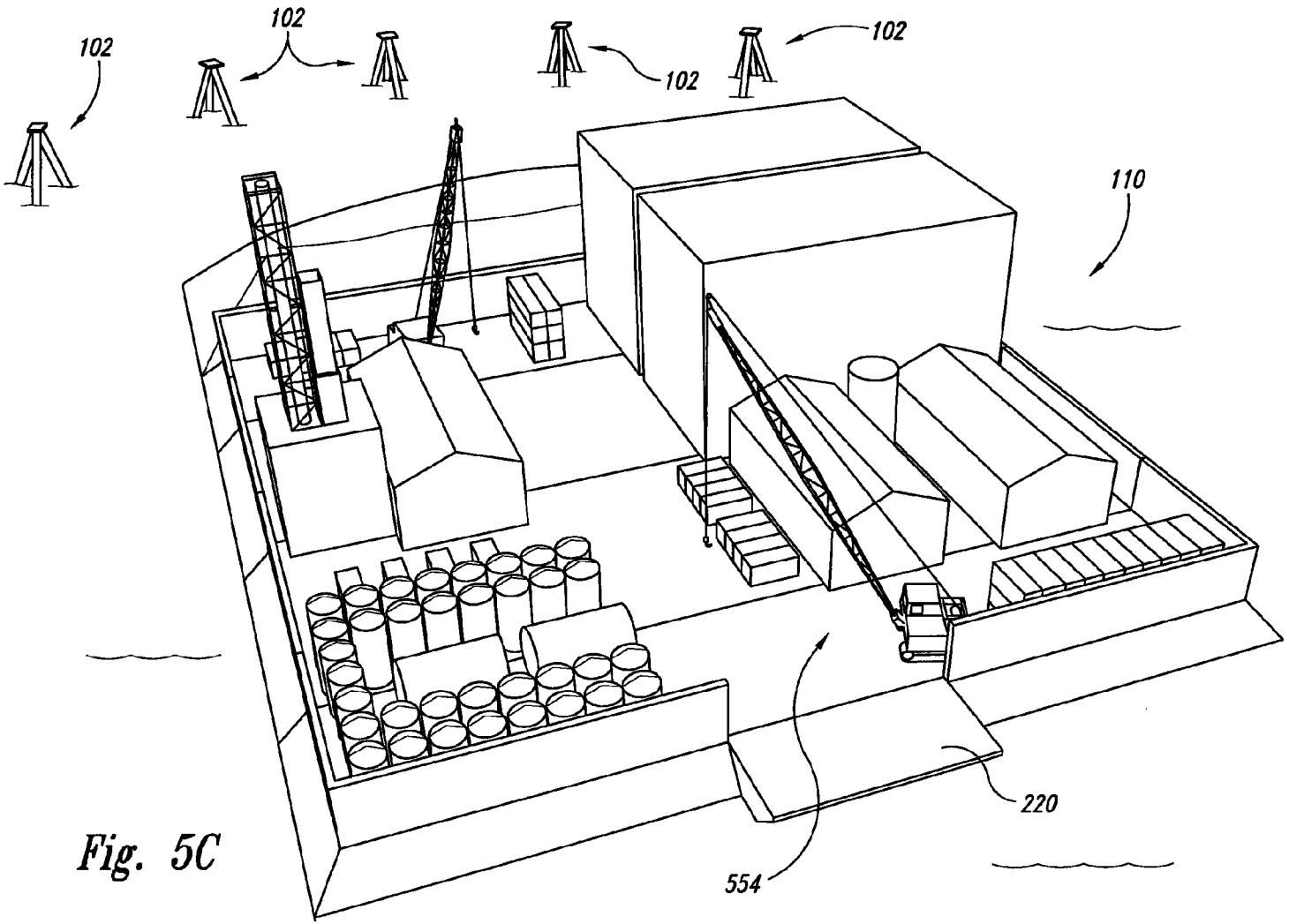
Figure 5D:
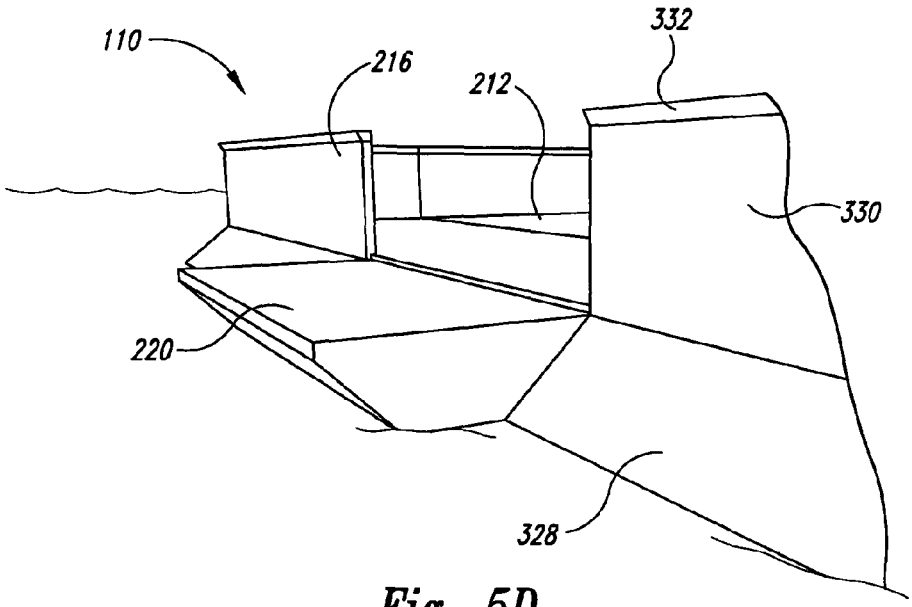
Figure 5E:
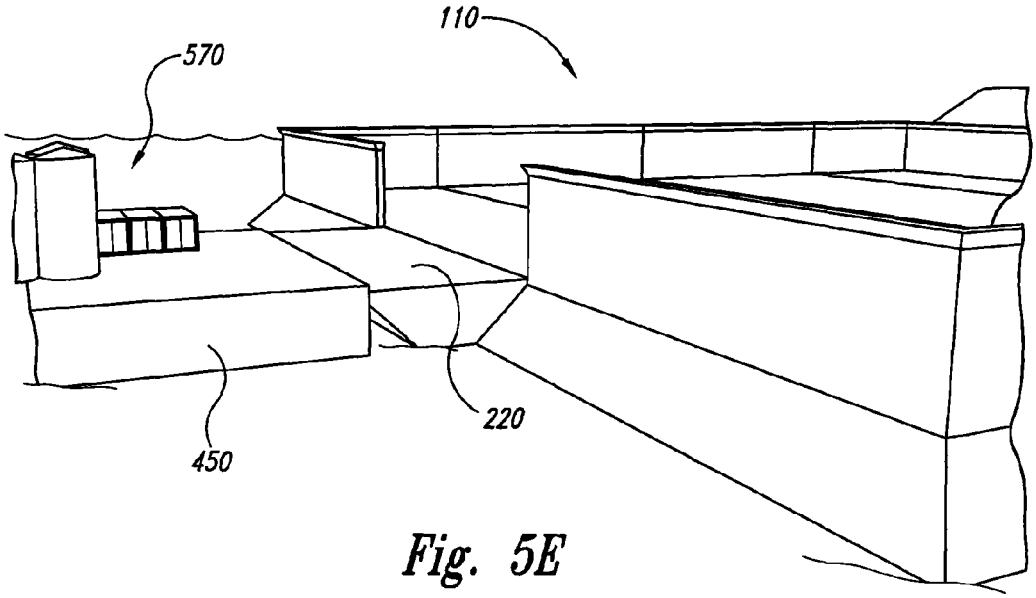
Figure 5F:
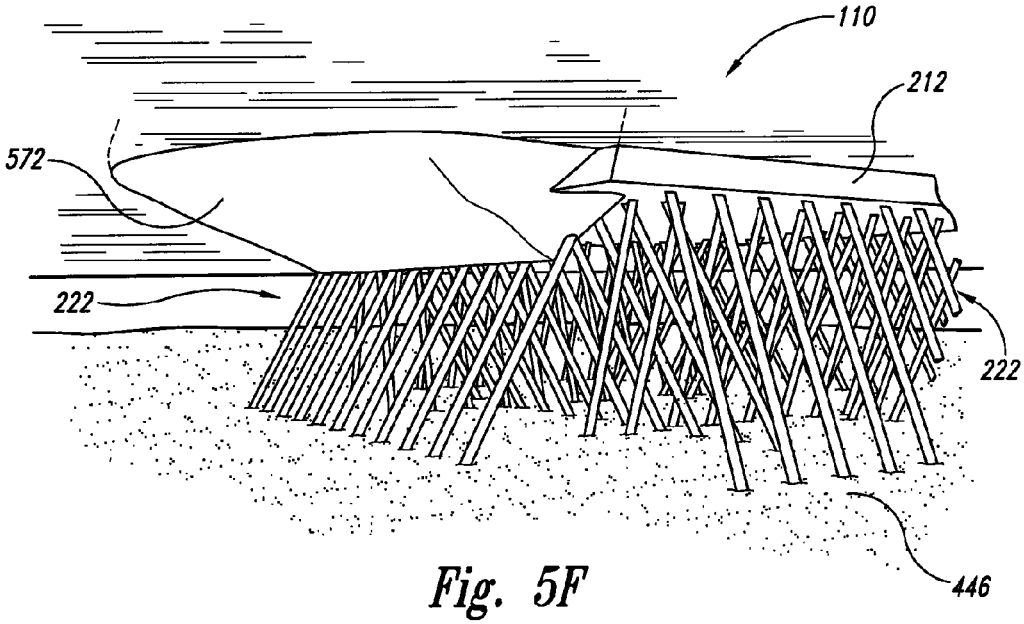
Figure 5G:
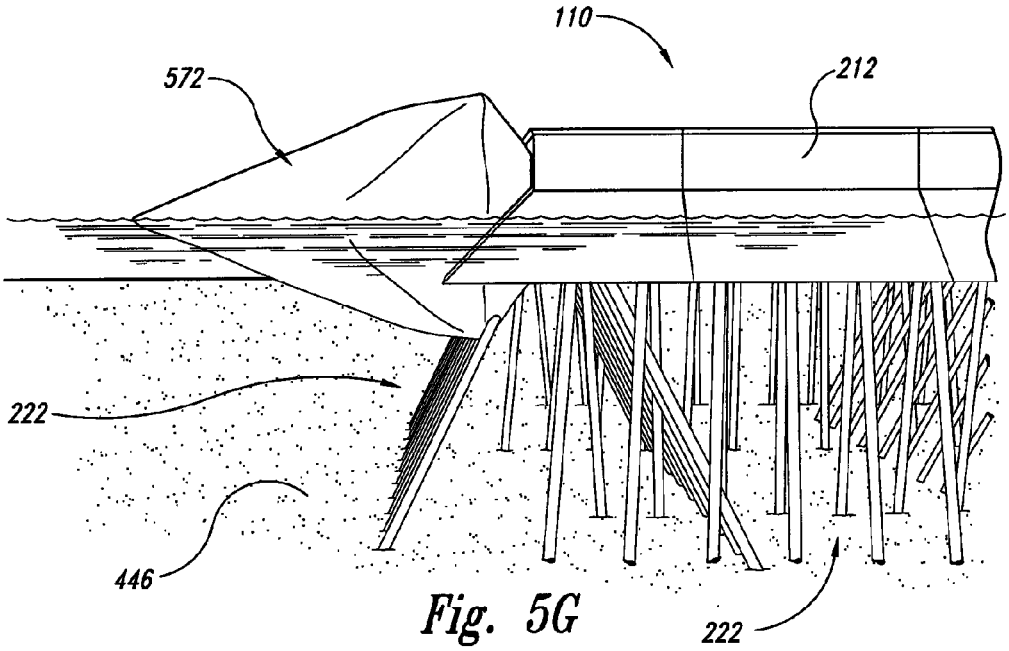
Figure 5H:
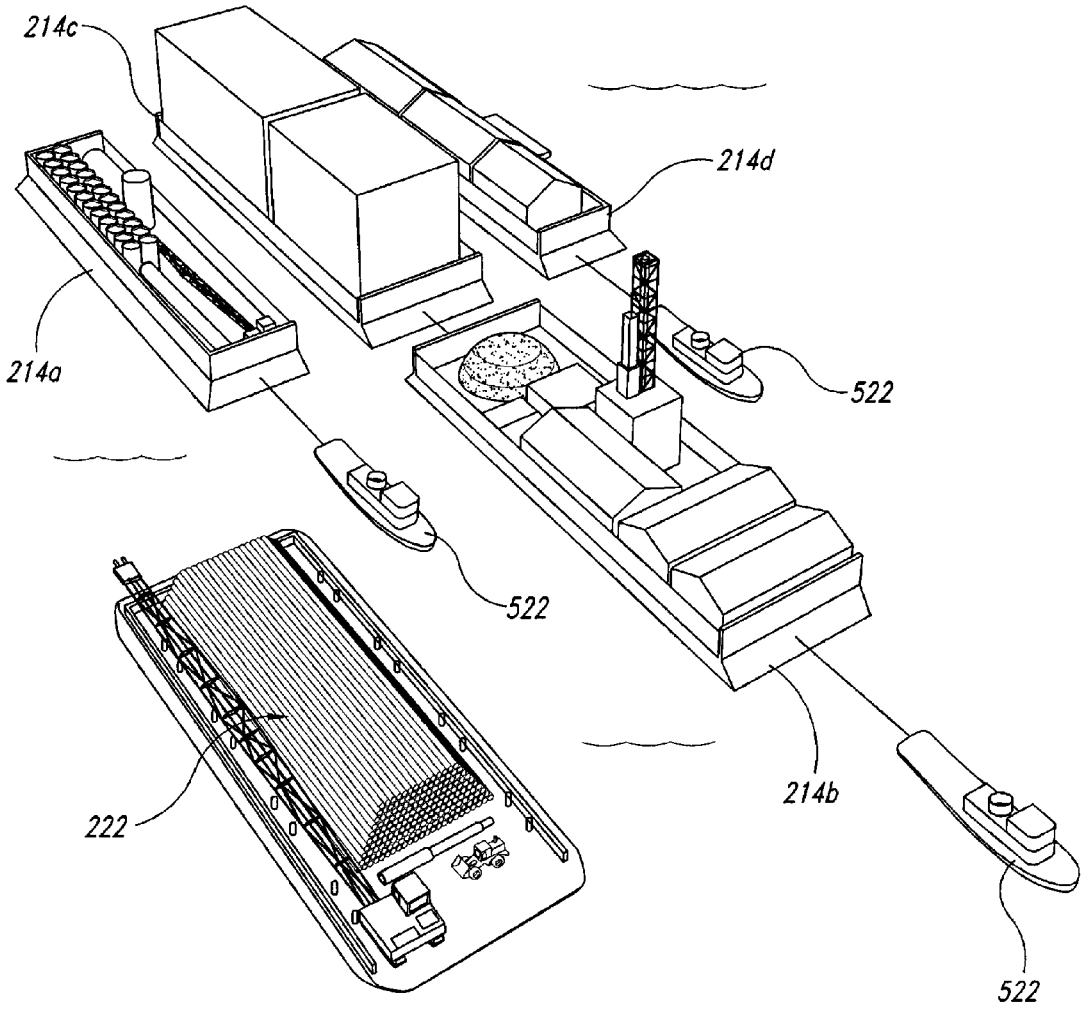

FIGS. 5A-5H are a series of isometric views illustrating various features of a platform system configured in accordance with embodiments of the disclosure. More specifically, FIG. 5A is an isometric view of a plurality of boats 552 transporting the corresponding individual platform portions 214 to a desired location. In certain embodiments, a single boat 552 can pull a single platform portion 214. However, as also illustrated in FIG. 5A, a single boat can also pull two or more platform portions 214 arranged in series. In another embodiment, the individual units could be equipped with the means of manned transportation. Transporting the individual platform portions 214 provides the benefit of traversing ice fields and/or other adverse weather conditions with structures having a relative small footprint. In another embodiment, the platforms may be connected offsite from the final installation location and transported by boat or other means to the final installation site. Moreover, as the boats 522 transport the separated or connected platform portions 214 to the desired location, the platform portions 214 are able to store all of the necessary construction and/or operation equipment and materials 554 to set up the platform at the desired destination. For example, the anchor piles 222 that will be used to secure the platform can be stored on one or more of the platform portions 214. In addition, the platform portions 214 can also store and transport cranes, drilling machines, fuel, water, drilling fluids, and/or any other materials, structures, or devices necessary for constructing and operating the platform. As also shown in FIG. 5H, the boats 522 can transport the platform portions 214 with preassembled or partially preassembled structures, such as storage facilities, housing, permanent structures, etc.

FIGS. 5B and 5C are isometric views of the constructed or partially constructed platform. Attachment of platforms portions 214 may include one or more connection methods including, for example post-tensioning, mechanically fastening, or welding, or grouted shear key connections. Various embodiments may contain combinations of the aforementioned connection methods.

FIG. 5B is an isometric view of the platform 110 in a partially assembled condition with the platform portions 214 attached to one another. As also shown in FIG. 5B, a crane or similar equipment 556 is driving one of the anchor piles 222 through the corresponding platform portion 214 to secure the anchor pile to the sea floor to stabilize and anchor the platform 110. FIG. 5C is an isometric view of the assembled platform 110 in an operational state. As shown in FIG. 5C, the assembled platform 110 accommodates all of the construction and/or operation equipment 554 that was transported on the modular platform portions 214 shown in FIG. 5A. The assembled platform 110 can also accommodate additional equipment and/or materials that are delivered to the platform 110 via the dock 220 or by other methods (e.g., aircraft). In this embodiment, the platform 110 is also positioned near rubble generators 102 to protect the platform 110 from the ice. Other embodiments may not include rubble generators.

The embodiments of the modularized platform 110 described above enable the platform to be easily transported to the desired location with self-contained construction capabilities. The platform 110 can also be constructed in a relatively short time and in a cost-effective manner. For example, transporting the necessary construction and/or operational equipment and materials on the platform portions 214 eliminates the need for separately transporting this equipment. Another embodiment is shown in FIG. 5H. This option may include transporting some or all of the permanent structures on the platform portions 214. A separate, temporary construction barge could be used to transport the foundation piles, construction equipment and remaining materials.

FIG. 5D is an isometric side view of the platform 110 illustrating the dock 220 extending from the platform body 212. The embodiment shown in FIG. 5D also illustrates the first inclined face 328, the vertical face 330, and the second inclined face 332 of the outer wall 216. FIG. 5E is an isometric side view of the platform 110 illustrating the secondary barge 450 positioned adjacent to the dock 220. The dock 220 provides convenient access to the platform 110 to load and/or unload supplies or equipment 570 between the platform 110 and the barge 450.

FIGS. 5F and 5G are underwater isometric side views of the platform 110. Referring to FIGS. 5F and 5G together, these Figures illustrate the multiple pairs of anchor piles 222 extending from the platform body 212 to the seafloor 446. According to one feature of the illustrated embodiment, anchor piles 222 (e.g., SPIN FIN® anchor piles) attached to the platform 110 are paired in sets of two. In addition, the anchor piles of the rubble generators 102 shown in FIG. 1 can also be paired in sets of two. The anchor piles 212 are able to withstand large loads in tension and even larger loads in compression. Moreover, in the paired configuration, bending of the anchor piles 222 is minimized and shear forces are transferred to the soil of the seafloor 446. According to another feature of the illustrated embodiment, the side wall 212 at least partially protects the platform 110 from ice rubble 572. The system 100 (see, e.g., FIG. 1) and associated platform 110 described herein, are therefore particularly suited for medium-depth arctic waters and/or open ocean conditions, such as, for example, the Beaufort, Chukchi, or other northern region seas. The embodiments described herein are also particularly suited to withstand or resist the forces associated from ice for many years.

Embodiments of the present disclosure are further suited for offshore islands or platforms in medium-depth water with multi-year ice environs because of the reduced transportation and set-up costs, as well as the methods these structures employ in resisting large ice forces. In addition, the systems and components of the present disclosure provide at least the following benefits: cost-effective and fast construction; resistance to ice forces and rubble ice in the several MN/m range; good logistic potential; self-contained construction potential with modularized components; capacity to hold water, fuel and drilling fluids; constructible in medium-depth water; wave and ice resistance; barge access and docking; water, sewage and fuel storage; and module access. Moreover, embodiments of the disclosure can also include any combination of the following features: multiple 100 foot×400 foot concrete or steel barges in a square connected configuration; pile sleeves in barges for driving large diameter batter anchor piles through in groups of two; capability to transport all materials and supplies needed on deck of the modular platform portions or in built-in tanks in the modular platform portions; capability to be ballasted and connected under open ocean conditions, such as in the Beaufort, Chukchi Seas or other northern region oceans for example, multi-year ice resistance of several MN/m; wave deflector walls to prevent over-topping; dock for receiving barges and boats; inclined face to fail ice sheets in bending at reduced forces as compared to ice compression failure; and anchor piles paired together in sets of two in the platform.

From the foregoing, it will be appreciated that specific embodiments have been described herein for purposes of illustration, but that various modifications may be made without deviating from the spirit and scope of the disclosure. Certain aspects and/or features described in the context of particular embodiments may be combined or eliminated in other embodiments. Further, although advantages associated with certain embodiments have been described in the context of those embodiments, other embodiments may also exhibit such advantages, and not all embodiments need necessarily exhibit such advantages to fall within the scope of the disclosure. The following examples provide further embodiments of the disclosure.

We claim:

1. A modular offshore platform system comprising:

a first platform portion configured to be individually transported to an offshore location, the first platform portion having a first interior surface, a first inclined face configured to be partially submerged in water at the offshore location, and a second inclined face;

a second partially submerged platform portion attached to the first platform portion, wherein the second platform portion is configured to be individually transported to the offshore location and assembled with the first platform portion at the offshore location, wherein the second platform portion includes a second interior surface, a first inclined face configured to be partially submerged in the water, and a second inclined face, and wherein when the first platform portion is attached to the second platform portion the first interior surface is connected to the second interior surface and the first and second inclined faces of the first and second platforms form at least a portion of an outer wall extending peripherally around the platform system that is configured to at least partially deflect water and/or ice; and a plurality of anchor pile sleeves configured to receive corresponding anchor piles extending at least partially through the first and second platform portions, wherein the anchor pile sleeves are coupled to the first and second platform portions, the anchor piles separate a bottom surface of the first and the second platform portions from a seafloor, and the anchor piles are configured to be coupled to the seafloor at the offshore location.

2. The modular offshore platform system of claim 1 wherein corresponding pairs of anchor pile sleeves are positioned in the first and second platform portions at an angle of approximately 40-70 degrees with reference to each other.

3. The modular offshore platform system of claim 1 wherein the first platform portion includes one or more cavities for carrying the anchor piles during transport of the first platform portion to the offshore location.

4. The modular offshore platform system of claim 1 wherein when the first platform portion is assembled with the second platform portion the outer wall further comprises:

a generally vertical face extending from the first inclined face;

and a generally horizontal top surface extending from the second inclined face.

5. The modular offshore platform system of claim 1 wherein the outer wall includes an opening therein at a dock portion of the platform.

6. The modular offshore platform system of claim 1 wherein each of the first and second platform portions is approximately 100 feet wide and 400 feet long.

7. A method of assembling an offshore platform at an offshore location, the method comprising:

transporting a first platform portion of the offshore platform to the offshore location, wherein the first portion includes a first interior surface, a first inclined face that is configured to be partially submerged in water at the offshore location, and a second inclined face;

transporting a second platform portion of the offshore platform to the offshore location, wherein the second platform portion is transported individually from the first platform portion, and wherein the second platform portion includes a second interior surface, a first inclined face that is configured to be partially submerged in the water, and a second inclined face;

attaching the first interior surface of the first platform to the second interior surface of the second platform portion at the offshore location, wherein the attached first and second platform portions are configured to form a base of the offshore platform, and wherein when the first platform portion is attached to the second platform portion the first and second inclined faces of the first and second platform form at least a portion of an outer wall extending peripherally around the base; and anchoring at least one of the first and the second platforms to a seafloor at a distance above the seafloor with a plurality of anchor piles.

8. The method of claim 7 wherein transporting the second platform portion comprises towing the second platform portion independently from the first platform portion.

9. The method of claim 7 wherein transporting the first platform portion comprises towing the first platform portion and transporting the second platform portion comprises towing the second platform portion behind the first platform portion.

10. The method of claim 7, further comprising:

transporting a third platform portion of the offshore platform to the offshore location individually from at least one of the first and second platform portions;

transporting a fourth platform portion of the offshore platform to the offshore location individually from at least one of the first, second, and third platform portions; and attaching the third platform portion to the second platform portion at the offshore location; and attaching the fourth platform portion to the third platform portion at the offshore location, wherein the attached first, second, third, and fourth platform portions are configured to form the base of the offshore platform.

11. The method of claim 7, wherein anchoring at least one of the first and second platform portions to the sea-floor is at the offshore location having a depth of approximately 50-150 feet.

12. The method of claim 7 wherein the first platform portion and the second platform portion are self-contained platform portions that carry materials and/or equipment for attaching the first platform portion to the second platform portion at the offshore location.

13. The method of claim 7 wherein transporting the first platform portion comprises carrying at least one of a crane, a drilling machine, fuel, water, and drilling fluids on the first platform portion.

14. The method of claim 7 wherein attaching the first platform portion to the second platform portion comprises ballasting at least one of the first and second platform portions at the offshore location.

15. A method of transporting a modular offshore platform to an offshore location, the method comprising:

towing a first platform section of the offshore platform to the offshore location wherein the first platform section includes a first inclined face that is configured to be partially submerged in water at the offshore location, and a second inclined face;

towing a second platform section of the offshore platform to the offshore location wherein the second platform section includes a first inclined face that is configured to be partially submerged in water at the offshore location, and a second inclined face;

attaching the second platform section to the first platform section at the offshore location, wherein the first and second inclined faces of the first and second platform form at least a portion of an outer wall extending peripherally around the base; and anchoring at least one of the first and second platform sections to a sea floor at the offshore location using a plurality of anchor piles such that the first and second platforms are partially submerged and bottom surfaces of the first and second platform are separated from the seafloor.

16. The method of claim 15 wherein towing the first platform section includes towing the first platform section with at least one anchor pile carried by the first platform section, and wherein anchoring at least one of the first and second platform sections includes anchoring at least one of the first and second platform sections with at least one of the anchor piles.

17. The method of claim 16 wherein towing the first platform section with the at least one anchor pile comprises towing the first platform section with the at least one anchor pile secured at least partially inside a cavity of the first platform section.

18. The method of claim 15 wherein anchoring at least one of the first and second platform sections to the sea floor includes anchoring at least one of the first and second platform sections with a plurality of corresponding pairs of anchor piles extending at least partially through at least one of the first and second platform sections.

19. The method of claim 18 wherein anchoring the first platform section includes anchoring the first platform section with the plurality of pairs of anchor piles including first and second anchor piles extending at least partially through the first platform section at an angle of approximately 40-70 degrees with reference to each other.

20. The method of claim 15 wherein towing the first and second platform sections includes towing the second platform section behind the first platform section.

* * * * *